United States Patent [19]

Ross

[11] Patent Number: 4,772,218

[45] Date of Patent: Sep. 20, 1988

[54] TERMINAL BLOCK

[76] Inventor: Don Ross, 1440 Mayson St., NE., Atlanta, Ga. 30324

[21] Appl. No.: 61,161

[22] Filed: Jun. 12, 1987

[51] Int. Cl.[4] ..... H01R 4/24

[52] U.S. Cl. ..... 439/387; 439/721

[58] Field of Search ..... 439/387, 401, 402, 406, 439/407, 514, 515, 723, 724, 721

[56] References Cited

U.S. PATENT DOCUMENTS

| | | | |
|---|---|---|---|
| 1,645,957 | 10/1927 | Lauter | 439/724 |
| 2,168,382 | 8/1939 | Alden | 29/155 |
| 2,725,544 | 11/1955 | Strange | 339/95 |
| 2,873,988 | 2/1959 | Bartholomew | 439/387 |
| 2,968,780 | 1/1961 | Roswell | 339/17 |
| 3,030,479 | 4/1962 | Ehrlich et al. | 200/168 |
| 3,064,227 | 11/1962 | Sams et al. | 339/95 |
| 3,122,604 | 2/1964 | Cook et al. | 174/51 |
| 3,187,295 | 6/1965 | Huska | 439/724 |
| 3,214,722 | 10/1965 | Weimer, Jr. | 339/95 |
| 3,319,215 | 5/1967 | Moore | 339/150 |
| 3,324,447 | 6/1967 | Pistey | 339/95 |
| 3,392,366 | 7/1968 | Nakazawa | 339/176 |
| 3,474,389 | 10/1969 | Nagano | 339/95 |
| 3,585,570 | 6/1971 | Jans | 339/95 |
| 3,609,642 | 9/1971 | Norden | 339/95 |
| 3,633,148 | 1/1972 | Thorsman | 439/723 |
| 3,638,171 | 1/1972 | Hulbrechtse | 339/164 |
| 3,656,087 | 4/1972 | Nutton | 339/95 |
| 3,945,711 | 3/1976 | Hohorst et al. | 339/95 |
| 4,036,545 | 7/1977 | Mysiak et al. | 339/95 |
| 4,084,876 | 4/1978 | Dinger | 339/95 |
| 4,106,835 | 8/1978 | Kimm | 339/95 |

FOREIGN PATENT DOCUMENTS

| | | | |
|---|---|---|---|
| 151244 | 10/1981 | German Democratic Rep. | 3/51 |

OTHER PUBLICATIONS

P-Nuts, manufactured by Neer Manufacturing Co., Inc., Box 3089, Lexington, OH 44904 (419) 884-2274; see attached advertisement.

*Primary Examiner*—Joseph H. McGlynn

*Attorney, Agent, or Firm*—Jones, Askew & Lunsford

[57] ABSTRACT

An improved terminal block for conductively interconnecting a plurality of electrical wires includes a plurality of guide passages conductively interconnected by an internal metal element. A leaf-spring element disposed within each guide passage has a tab formed thereon inclined toward the wire and extending along the wire in the direction of insertion. A wire inserted into the guide channel is easily inserted between the tab and the conductive element and is biased into contact with the conductive element by the leaf-spring. If the wire is pulled, the tab tends to bite into the wire, resisting disengagement. The transverse axis of the tab forms an acute angle with respect to the transverse axis of the wire, such that the wire can be twisted from beneath the tab and "unscrewed" from its guide passage.

2 Claims, 2 Drawing Sheets

TERMINAL BLOCK

TECHNICAL FIELD

The present invention relates generally to an apparatus for conductively connecting a plurality of electrical wires, and relates more specifically to a terminal block wherein each of the wires inserted into the terminal block is individually gripped and cannot be pulled out of the block but can only be twistingly disengaged from the block.

BACKGROUND OF THE INVENTION

In conventional electrical wiring applications, it is often necessary to conductively interconnect a number of electrical wires. Such a need would arise, for example, when a single "hot" wire must be branched off to a number of separate electrical outlets or lighting fixtures. So-called "wire-nuts" are traditionally used to connect a number of individual wires by twisting the bare ends of the wires together. Hosever, these wire nuts suffer a number of disadvantages, among them limitations as to the number of wires that can be interconnected. Furthermore, when several wires are connected by a single wire nut, if one wire pulls loose from the wire nut, the remaining wires are not wedged so tightly together and are more apt to pull loose also.

Accordingly, there is a need to provide a means for interconnecting a plurality of electrical wires which does not limit the number of wires which can be interconnected.

There is a further need to provide a means for interconnecting a plurality of electrical wires wherein a single wire can be disengaged from the connector without affecting the security with which the remaining wires are engaged by the connector.

Terminal blocks are known which permit easy insertion of the electrical wire but which resist the wire being pulled out of the terminal block. A widely used type of terminal block provides a plurality of wire-receiving guide passages into which the ends of electrical wires are inserted. The guide passages are electrically connected by an internal metal slip, and resilient leaf-spring wireretainers disposed at acute angles to the wire-insertion paths bias the inserted wires into contact with the metal strip. During insertion, the wire is simply pushed into position between the leafspring and the conductive element opposite the spring. By forming the leaf-spring members such that they incline toward the wire and extend along the wire in the direction of insertion, forming an acute angle to the wire, the edge of the leaf-spring at the end of each wire-engaging portion tends to dig into the wire to resist pull applied to the wire. This arrangement is such that very large pull forces are inherently resisted by the leaf-spring.

While such an arrangement affords ease of connecting the wires and resistance to accidental disengagement of the wires from the terminal block, it suffers certain disadvantages in that if it is desired to purposely disengage the electrical wire from the terminal block, disengagement cannot easily be accomplished. Specifically, the leaf-spring member resists pull applied to the wire so efficiently that the wire cannot be extracted from its guide passage and must be cut.

Accordingly, there is a need to provide a terminal block which affords ease of insertion and resistance to accidental disengagement of the electrical wire from the terminal block, but which permits the wire to be intentionally disengaged should the situation so require.

SUMMARY OF THE INVENTION

As will be seen, the present invention overcomes these and other disadvantages associated with prior art terminal blocks. Stated generally, the terminal block of the present invention provides a means for conductively interconnecting a plurality of electrical wires. The improved terminal block affords ease of insertion of the wires into the terminal block and resistance to accidental disengagement of the wires from the terminal block. Each wire is individually secured to the terminal block such that a single wire can be disconnected from the terminal block without impairing the connection of the remaining wires. Should it become necessary to disconnect a wire from the terminal block, the wire can be intentionally disengaged from the terminal block without the need to cut the wire or disassemble the terminal block and without the need for any special tools.

Stated more specifically, the terminal block of the present invention comprises a housing defining a plurality of wirereceiving guide passages. An internal metal element conductively interconnects the various guide passages. An arcuate leaf-spring member disposed within each guide passage biases an electrical wire inserted into the guide passage into conductive contact with the opposing metal conductive element. Each resilient leaf-spring element has at least one tab formed thereon, the tabs inclining toward the wire and extending along the wire in the direction of insertion, forming an acute angle to the wire. In addition, the transverse axis of the tab is angled with respect to a perpendicular to the longitudinal axis of the wire. During insertion of the wire, the end of the wire is simply pushed into position between the leafspring and the conductive element opposite the spring and twisted to increase the spring tension. If tension is applied to the wire, the edge of the tab bites into the wire to resist accidental disengagement of the wire from the terminal block. If it is desired to intentionally disengage the wire from the terminal block, since the transverse axis of the tab is angled with respect to the transverse axis of the wire, a simple untwisting of the wire will permit the wire to be "unscrewed" from beneath the tab, permitting the wire to be threadingly disengaged from its guide passage.

Thus, it an object of the present invention to provide an improved terminal connecting block.

It is a further object of the present invention to provide a terminal block which permits wires to be easily inserted into the terminal block while resisting accidental disengagement of the wires for the terminal block, yet which permits intentional disengagement of the wires from the terminal block.

It is a further object of the present invention to provide a terminal block wherein wires once inserted into the block can be easily disengaged from the block without cutting the wire, without the need for special tools, and without the need for disassembling the terminal block.

Other objects, features, and advantages of the present invention will be come apparent upon reading the following specification, when taken in conjunction with the drawings and the appended claims.

BRIEF DISCRIPTION OF THE DRAWINGS

DETAILED DESCRIPTION OF THE DISCLOSED EMBODIMENT

Figure 1:
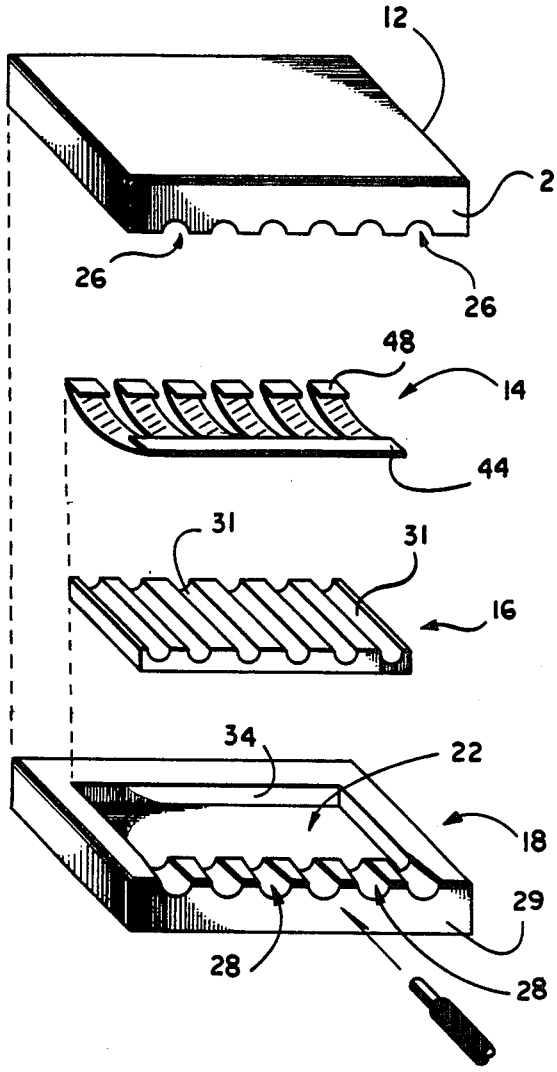
FIG. 1 is an exploded perspective view of a terminal block according to the present invention.

Referring now to the drawings, in which like numerals indicate like elements throughout the several views, FIG. 1 shows an improved terminal block 10 according to the present invention. The terminal block 10 is essentially comprised of four elements: an upper housing section 12, a leaf-spring member 14, an internal conductive member 16, and a lower housing section 18. While the preferred embodiment is disclosed with respect to a terminal block for conductively interconnecting six wires, it will be understood that embodiments for conductively interconnecting a greater or lesser number of wires can be provided without departing from the scope and spirit of the appended claims.

The upper and lower housing sections 12, 18 are formed from an electrically insulating material such as plastic. The upper housing section 12 has a recess 20 (FIG. 3) formed in the lower portion thereof. The lower housing section 18 has a recess 22 (FIG. 1) formed on a mutually facing upper portion such that when the upper and lower housing sections are matingly assembled, an interior cavity 24 is formed by the recesses 20, 22. The upper and lower housing sections 12, 18 of the preferred embodiment are designed to be snap-fitted together in a conventional manner, though it is contemplated that other fastening means, such as screws, rivets, or adhesives, may be employed.

Figure 3:
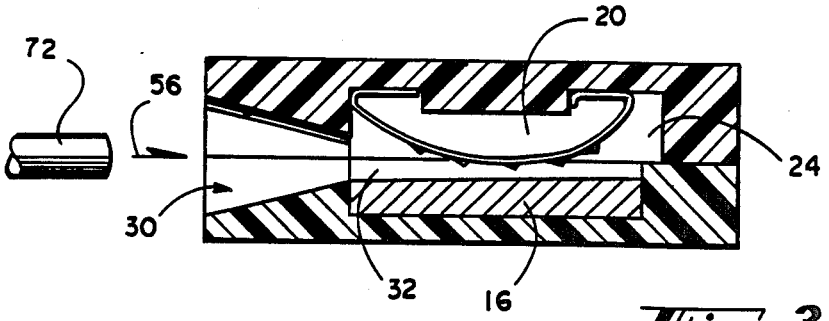
FIG. 3 is a side cutaway view of the terminal block of the present invention, taken along line A—A of FIG. 1, showing an electrical wire about to be inserted into a guide passage.
Figure 4:
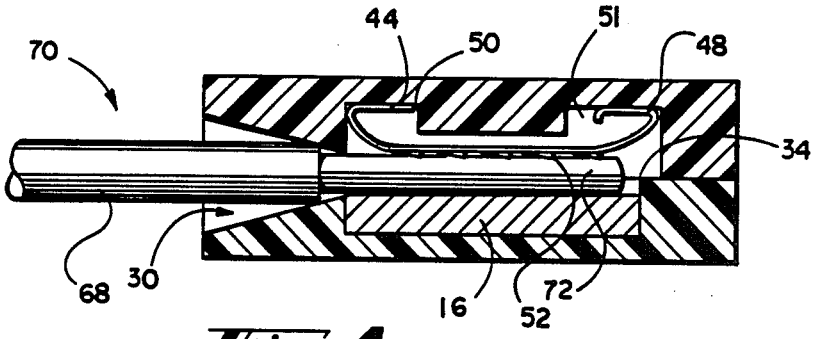
FIG. 4 is a side cutaway view of the terminal block of FIG. 3 with an electrical wire inserted into the guide passage.
Figure 5:
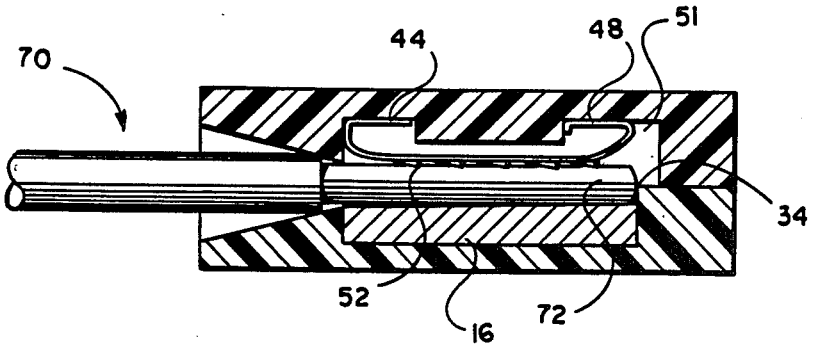
FIG. 5 is a side cutaway view of the terminal block of FIG. 3 with the electrical wire twisted to increase the tension of the leaf-spring element against the wire.

A plurality of semi-frustoconical channels 26 whose axes are substantially parallel are formed at the forward end 27 of the upper housing portion 12. Similarly, a corresponding plurality of semi-frustoconical channels 28 are formed at the forward end 29 of the lower housing portion 18. When the upper and lower housing portions are matingly assembled as shown in FIGS. 3–5, each semi-frustoconical channel 26 on the upper housing portion 12 mates with a corresponding semi-frustoconical channel 28 on the lower housing portion 18 to form a plurality of frustoconical bores 30 (FIGS. 3–5) opening into the interior cavity 24 of the housing.

The internal conductive member 16 is formed of an electrically conductive material such as copper. The conductive member 16 has a plurality of parallel, semi-cylindrical channels 31 formed thereon. The conductive member 16 is received within the recess 22 formed in the lower housing portion 18. With the internal conductive element 16 thus positioned within the recess 22 in the lower housing section 18, the semi-cylindrical channels 31 of the internal conductive member 16 are coaxially aligned with the semi-frustoconical channels 28 formed at the forward end 29 of the lower housing portion 18 to form a plurality of guide passages 32 within the terminal block 10. The guide passages 32 of the internal conductive member 16 terminate at the rear wall 34 of the lower housing portion 18.

The leaf-spring member 14 is formed from a conventional resilient metal such as phosphor bronze or steel. The leaf-spring member 14 includes a plurality of downwardly-bowed leaf-spring elements 40. The number of leaf-spring elements corresponds to the number of guide passages 32 formed in the conductive member 16 in the lower housing portion 18. The leafspring elements are disposed in parallel, spaced-apart relation and are joined at one end by a cross member 42. The cross member 42 has an inwardly-depending flange 44 formed thereon. At the opposite end 46 of each leaf-spring element 40 is an inwardly-depending flange 48. The leaf-spring member 14 is mounted within the recess 20 in the lower portion of the upper housing section 12. As can be seen in FIGS. 3–5, the flanges 44, 48 are received within transverse channels 50, 51 formed in the base of the recess 20 in the upper housing portion 12. The flange 44 is dimensioned to fit snugly within the transverse channel 50 to maintain the leaf-spring member 14 within the recess 20 in the upper housing section 12. However, the flanges 48 at the opposite end of the leaf-spring member 14 are narrower than the transverse channel 51 such that the flanges 48 are slidable back and forth (left and right as viewed in FIGS. 3–5) within the transverse channel 51.

When the terminal block is assembled with the leaf-spring member 14 thus mounted within the recess 20 in the upper housing section 12, the spaced-apart relation between the various leafspring elements 40 is such that a leaf-spring element is disposed adjacent each guide passage 32.

Referring now to FIGS. 3–5, each leaf-spring element 40 has at least one tab 52 formed thereon. The tabs 52 of the preferred embodiment are formed by punching through the leaf-spring element along three sides of a parallelogram and bending the tab downwardly along the fourth side. The tabs 52 incline downwardly toward the conductive member 16 and extend along the guide passages 32 in the direction of wire insertion, which direction is indicated by the arrow 56 in FIG. 3. In this manner, the tabs 52 form acute angles to the direction of insertion, as seen in FIG. 4.

Figure 2:
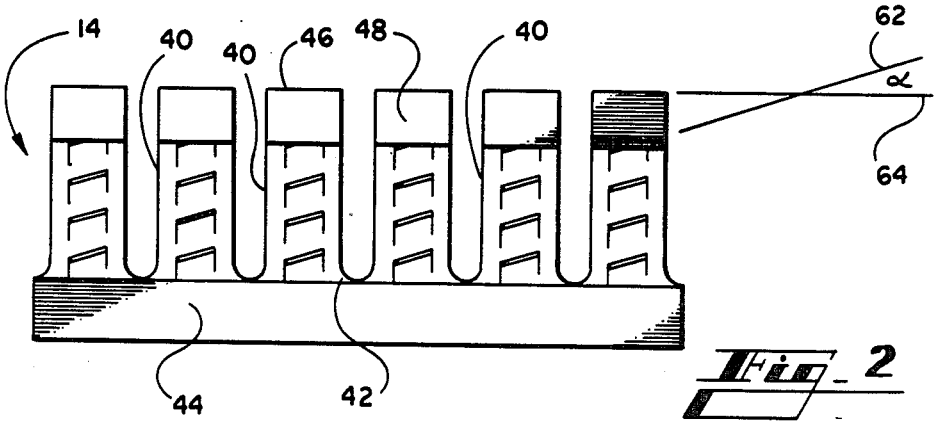
FIG. 2 is a top view of the leaf-spring member of the terminal block of FIG. 1.

Referring now to FIG. 2, it can be seen that the transverse axis 62 of the tabs 52 forms an acute angle $\alpha$ with respect to a plane 64 perpendicular to the direction of insertion. In the disclosed embodiment, the tabs form an angle $\alpha$ of from 15° to 30° with respect to perpendicular. The significance of the angular orientation of the tabs 52 with respect to perpendicular will be more fully explained hereinbelow with respect to the operation of the terminal block 10.

Referring now to the operation of the terminal block 10, when it is desired to conductively interconnect a plurality of electrical wires, such as to connect a single "hot" wire to a number of "branch" wires, the insulation 68 is stripped from the end of each wire 70, and the bare end 72 of the wire is inserted into a guide passage 32, as shown in FIG. 3. Since all of the guide passages 32 are conductively interconnected, it makes no difference into which guide passage the "hot" wire is inserted. As the end 72 of a wire 70 is inserted, the wire is pushed into position between the corresponding leaf-spring element 40 and the internal conductor element 16 opposite the leaf-spring element, as shown in FIG. 4. As the end 72 of the wire 70 is pushed between its corresponding leaf-spring element 40 and the internal conductor element 16, the leaf-spring element tends to flatten out. The facilitate this deformation, the flange 48 slides within the transverse channel 51 toward the right as seen in FIG. 4. The leaf-spring element 40 biases one or more of the tabs 52 against end 72 of the the wire 70, which in turn biases the wire against the internal conductive element 16. The wire 70 is then twisted in a clockwise direction, and the angled tabs 52 on the leaf-spring element 40 threadingly engage the end 72 of the wire. As the wire is twisted, it will threadingly advance into the guide passage 32 until either the end 72 of the wire abuts the rear wall 34 of the lower housing portion 18 at the end of the guide passage, or the insulation 68 is brought to bear against the frustoconical bore 20 at the entrance of the guide passage. At that point, the wire 70 will advance no further into the connector, and further twisting of the wire will impart an opposite force against the angled tabs 52. This force will tend to displace the tabs 52 toward the left as seen in FIG. 5, causing the leaf-spring element 40 to bow, thereby increasing the tension of the leaf-spring element against the wire. It will be appreciated that this bowing action is facilitated by the ability of the flange 48 to slide within the transverse channel 51, thereby displacing the flange 48 toward the left as seen in FIG. 5. With each wire thus inserted into its respective guide passage 32, the wires are conductively interconnected by means of the internal conductive element 16.

With the tabs 52 angled along the wire in the direction of insertion, in case of a pull on the wire, the tabs tend to dig into the wire. This arrangement is such that very large pulling forces exerted on the wires can be resisted, preventing the wires from becoming accidentally disengaged from the terminal block.

If it is desired to intentionally disengage a wire from the terminal block, such can be accomplished without special tools and without the need for disassembling the terminal block. Since the transverse axis of the tabs forms an angle with respect to the transverse axis of the wire in much the same manner as the threads of a screw, a twisting motion applied to the wire in a counterclockwise direction will thread the wire from beneath the tabs permitting the wire to be "unscrewed" from its guide passage.

One feature of the present invention is the provision of a tab whose transverse axis is angled with respect to the plane perpendicular to the axis of the wire. The advantage of this feature is that, while the tab will bit into the wire and prevent the wire from being pulled out of its guide channel, a twisting action exerted on the wire will permit the wire to be threaded beneath the tab and disengage from the terminal block. Thus, the wire can be disconnected from the terminal block without having to cut the wire, without having to disassemble the terminal block, and without the need for any special tools.

Another feature of the preferred embodiment is the provision of the flange 48 which "floats" back and forth within the transverse channel 51 as the leaf-spring element 40 is deformed. The provision of a leaf-spring member with one fixed end and one floating end facilitates the insertion of a wire beneath the spring, and also facilitates the tightening action occasioned by twisting the wire as hereinabove described.

While the preferred embodiment is disclosed with respect to a terminal block wherein all of the wire-receiving guide passages open along one side of the housing, it will be understood that the present invention contemplates arrangements where some guide passages open along one side of the block, while others, for example, every other guide passage, open along the opposite side. In such an embodiment, the leaf-spring element associated with each passage would be oriented so that the tab extends along its corresponding guide passage in the direction of wire insertion.

Further, while the preferred embodiment is disclosed with respect to a terminal block wherein all of the guide passages are parallel to one another, it will be understood that the present invention contemplates arrangements wherein the guide passages are otherwise oriented with respect to one another. For example, a circular terminal block might be provided, with the guide passages radially arranged therein and opening outwardly around the circumference of the housing.

Finally, it will be understood that other modifications may occur to those skilled in the art without departing from the scope and spirit of the appended claims.

What is claimed is:

1. A terminal block for conductively connecting a plurality of electrical wires, comprising:

a housing;

walls defining a plurality of channels within said housing, each of said channels dimensioned to receive the end of an electrical wire;

conductor means for conductively interconnecting the wires inserted in each of said channels;

a leaf spring associated with each of said channels for biasing said wires inserted into said channels into frictional engagement with a wall of their respective channels; and at least one angular tab formed on each of said leaf springs, said angular tab having a transverse edge which forms an acute angle with a plane normal to the longitudinal axis of its respective channel such that said transverse edge of said angular tab wedgingly engages a wire inserted into said channel to prevent it from being disengaged from said channel by a pulling force exerted along the length of said wire, but such that said wire can be disengaged from its channel by twisting said wire.

2. The terminal block of claim 1, wherein said leaf-spring has one end fixedly mounted within said housing and its other end moveable with respect to said housing to facilitate deformation of said leaf-spring.

* * * * *